US006749382B2

(12) United States Patent
Lambie

(10) Patent No.: US 6,749,382 B2
(45) Date of Patent: Jun. 15, 2004

(54) GUIDE FOR BANDING MATERIAL

(76) Inventor: Michael G. Lambie, 22 Chinook St., Pulaski, NY (US) 13142

( * ) Notice: Subject to any disclaimer, the term of this patent is extended or adjusted under 35 U.S.C. 154(b) by 0 days.

(21) Appl. No.: 10/242,868

(22) Filed: Sep. 13, 2002

(65) Prior Publication Data

US 2004/0052604 A1 Mar. 18, 2004

(51) Int. Cl.[7] ..... B65B 13/08
(52) U.S. Cl. ..... 410/97; 81/488; 16/110.1
(58) Field of Search ..... 410/97; 81/488; 100/29, 32; 16/110.1

(56) References Cited

U.S. PATENT DOCUMENTS 1,076,792 A * 10/1913 Sedam
1,481,464 A * 1/1924 Grow
1,737,779 A * 12/1929 Stanbrough
5,344,277 A * 9/1994 Sandland ..... 414/607
5,560,180 A * 10/1996 Rodriguez et al. ..... 100/29
6,607,337 B1 * 8/2003 Bullock ..... 410/97

FOREIGN PATENT DOCUMENTS

DE 10011909 A1 * 9/2001 ..... B65B/13/08
JP 363307008 * 12/1988 ..... 100/32
WO 84/00022 * 1/1984 ..... B65B/13/08

* cited by examiner

*Primary Examiner*—D. Glenn Dayoan
*Assistant Examiner*—H. Gutman
(74) *Attorney, Agent, or Firm*—Wall Marjama & Bilinski LLP

(57) ABSTRACT

A guide for passing a tie-down band underneath a pallet. The guide includes a guide body having a pair of spaced apart slotted holes passing there through. One end of a tie-down band is passed through one of the slotted holes and is looped around and passed through the second slotted hole to securely hold the band within the guide body. An elongated handle is threaded into the back of the guide body. The handle is of sufficient length such that it can be used to pass the guide body underneath a pallet of a given length.

17 Claims, 3 Drawing Sheets

GUIDE FOR BANDING MATERIAL

FIELD OF THE INVENTION

This invention relates to apparatus for efficiently passing a length of a tie-down banding material underneath a shipping pallet upon which cargo is loaded so that the ends of a band can be looped about the cargo and joined together thus securing the cargo to the pallet.

BACKGROUND OF THE INVENTION

Typically metal or plastic tie-down material is provided to the end user wound upon relatively large spools. The spool assemblies are, in turn, mounted upon carriages so that the assemblies can be easily moved from place to place. The banding material that is stored upon the spool generally assumes its stored shape upon the spool and thus tends to curl when unwound from the spool. This, in turn, makes it extremely difficult to pass the free end of the material underneath a pallet. The free end of the banding material generally turns back upon itself and becomes entangled between the platform planking of the pallet.

Various attempts have been made to correct this problem, however, none to date have been entirely successful. For the most part these prior art devices are cumbersome and thus difficult to move about a work area. In addition, these prior art devices typically can only service one size pallet using a single size tie-down band which limits their usefulness.

SUMMARY OF THE INVENTION

It is therefore an object of the present invention to improve apparatus for banding cargo to a pallet.

A further object of the present invention is efficiently passing a tie-down band beneath a cargo pallet.

A still further object of the present invention is to provide apparatus for passing tie-down bands of varying sizes efficiently beneath cargo pallets having different lengths.

These and other objects of the present invention are attained by a guide for passing a tie-down band beneath a pallet that includes a guide body having a pair of spaced apart parallel slotted holes passing through the body. The slotted holes are sized to provide a close running fit for a band suitable for tying down cargo mounted upon the pallet. One end of the band can pass through one of the slotted holes, then being looped around and passed back through the other slotted hole to secure the band in the guide body. An elongated handle is secured to the guide body, the handle having a length sufficiently long enough to pass the guide body underneath the pallet between the pallet skids.

In another form of the invention, a plurality of guide bodies are arranged so that they each can be interchangeably connected to any one of a number of handles each of which has a different length. Each guide body contains a pair of spaced apart parallel slotted holes that pass through the guide body. The hole pair in each guide body is arranged to provide a close running fit with a specific size band. Accordingly, a selected guide body can be mated with a selected length handle to service different length pallets carrying varying types of cargo.

BRIEF DESCRIPTION OF THE DRAWING

For a better understanding of these and objects of the invention, reference will be made to the following detailed description of the invention which is to be read in connection with the accompanying drawing, wherein.

DETAILED DESCRIPTION OF THE INVENTION

Figures 1, 2:
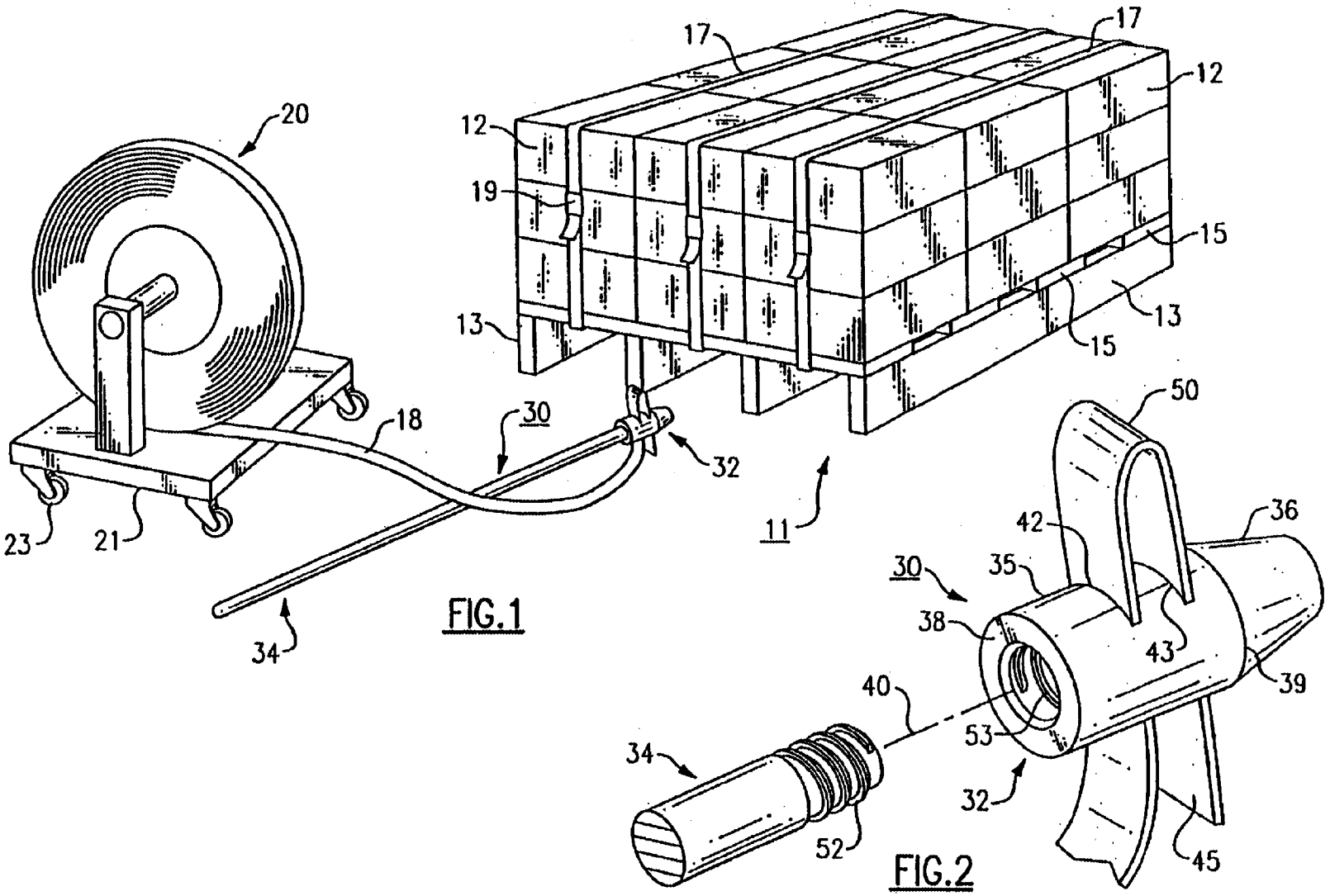
FIG. 1 is a perspective view of a typical pallet shown supporting a cargo that has been secured to the pallet by bands supplied from a spool.
FIG. 2 is an enlarged view in perspective of a band guide embodying the present invention.

Referring initially to FIG. 1, there is illustrated a pallet, generally referenced 11, that is of typical construction and is shown supporting a cargo made up of stacked boxes or shipping crates 12. As is well known in the art, the pallet includes a series of parallel skids 13—13 that extend longitudinally along the length of the pallet. A platform is constructed over the skids by placing a series of spaced apart planks 15—15 on top of the skids. The planks are perpendicularly aligned with the skids and extending laterally across the width of the pallet. The pallet typically is fabricated from a hard wood such as oak or maple, however, pallets made from synthetic materials or the like are currently being used in certain applications.

Although the cargo illustrated in FIG. 1 consists of a series of stacked crates, almost any type of load, symmetrical or otherwise, may be loaded upon the pallet for storage or shipment. As illustrated in FIG. 1, the cargo is secured to the pallet using bands 17 fabricated of flat metal or any suitable synthetic materials. One end of the band is generally passed under the pallet platform between the skids and the two ends are brought together to form a loop encircling both the pallet and the cargo. The two ends of the loop are engaged by a special tool that tightens the loop to hold the cargo securely against the platform and the ends of the loop are then crimped together and locked by a clip 19 to close the loop.

The banding material 18 is stored upon a relatively large spool or reel 20. The spool, in turn is rotatably supported upon a carriage 21 having casters 23 so that the spool can be easily moved about the work place to service a number of pallets at different locations. However, as noted above, the band that is stored on the spool typically possesses some memory and comes off the spool with an arcuate or curved contour that makes it difficult for the band to be passed beneath the pallet. The curved free end of the band invariably gets caught between the planks of the platform. This results in a good deal of time being wasted in untangling the band from the pallet and in trying again to pass the band beneath the pallet.

With further reference to FIG. 2, there is illustrated a band guide, generally referenced 30, that embodies the teachings of the present invention. The band guide includes two main sections which are a head 32 and an elongated handle 34. The head section of the band guide further includes a guide body 35 and a nose cone 36. The body is cylindrically shaped and has a rear end face 38 and a front end face 39 both of which are perpendicularly aligned with the axis 40 of the guide.

The nose cone is joined to the front end face of the body and is shaped like a truncated cone that tapers downwardly from the body toward the axis 40. The nose cone serves to provide the guide body with a streamlined front end which, as will become apparent from the disclosure below, allows the guide body to be easily passed beneath the platform of the platen between the skids. Preferably, the guide body and the nose cone are integrally molded from a plastic, however, it can be fabricated from metal or any other suitable material without departing from the teachings of the present invention.

A pair of spaced apart parallel slotted holes 42 and 43 are formed in the guide body with the holes passing through the guide perpendicular to the axis 40. The slotted holes are rectangular in cross section to complement the cross section of the banding material. In practice, one end 45 of the banding material is unwound from the spool and is passed through one of the slotted holes. The end of the band is then looped over and passed back through the other slotted hole. The slotted holes are sized with regard to the size of the banding material to provide a close running fit between the banding material and the walls of the holes. The holes, in addition, are placed relatively close together so that the loop in the banding material forms a tight bend 50. As a result, when the end of the banding material is threaded through the guide body as shown in FIG. 2, the material is held snugly within the guide body.

The elongated handle 34 of the guide contains a male thread 52 at one end that is arranged to mate with a female thread 53 that passes into the guide body through the rear end face 38 of the guide body. The handle preferably is fabricated of wood but may also be made of plastic, aluminum or any other suitable material. The handle has a length that is slightly longer than that of the pallet. As should now be evident, the handle can be removably secured to a guide body holding the banding material and the guide body, in turn, then easily passed beneath the platform of the pallet. Once through the pallet, the banding material is removed from the guide body and sufficient banding material is unwound from the spool to encircle the cargo. As explained above, the two ends of the band formed are drawn together to secure the encircled cargo to the pallet and are crimped and locked together in a manner that is well known in the art.

Figure 3:
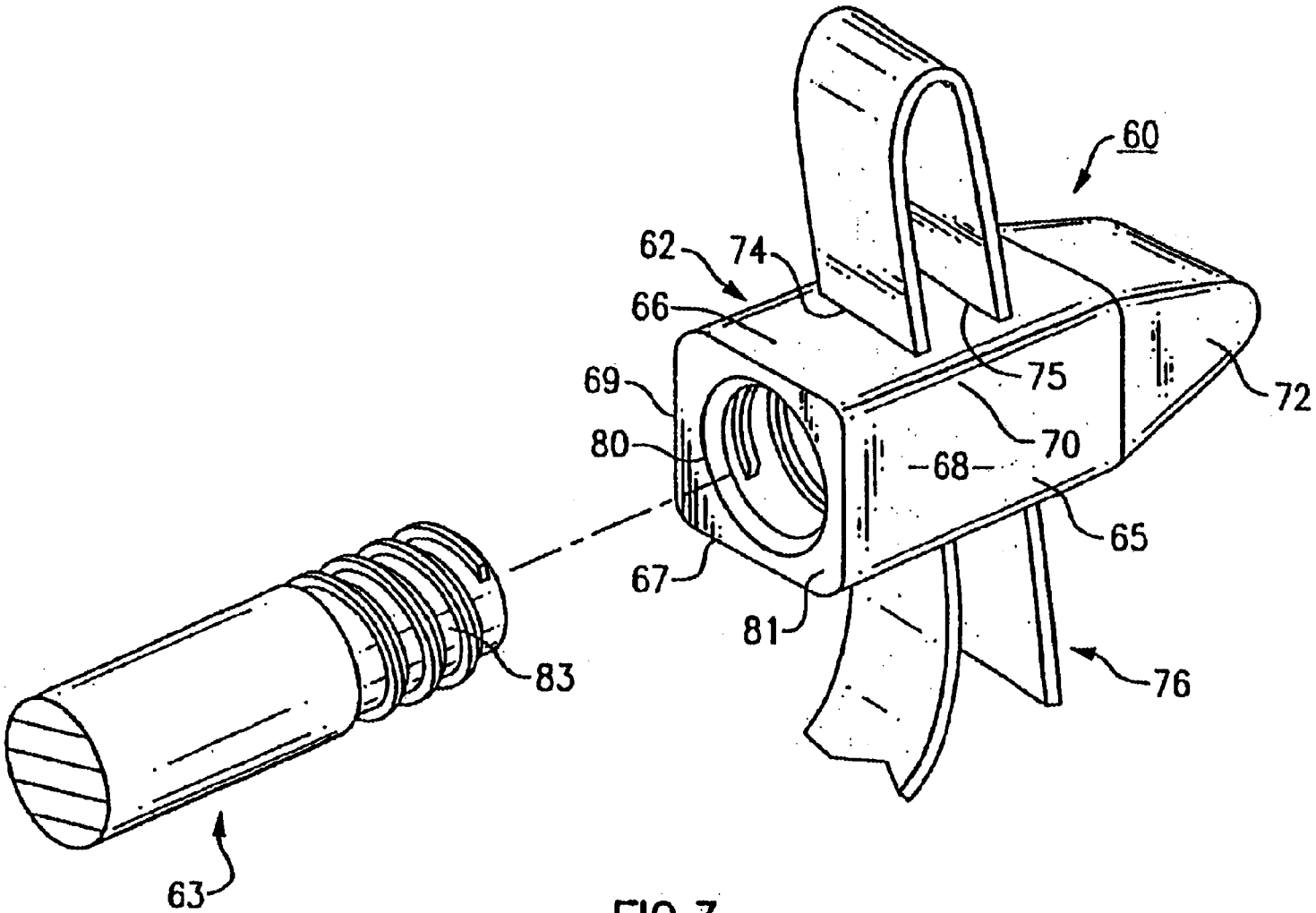
FIG. 3 is an enlarged perspective view illustrating a further embodiment of the invention.

Turning now to FIG. 3, there is illustrated another embodiment of the invention. Here again the band guide 60 includes a head section 62 and a handle section 63. The head section includes a guide body 65 that is rectangular shaped and contains a top wall 66, bottom wall 67 and two side walls 68 and 69. The walls are cojoined by generous well rounded radii such as radii 70. The body is integrally joined to a pointed nose piece 72. The body and nose piece are preferably integrally molded from a strong plastic material.

A pair of parallel, spaced apart, slotted openings 74 and 75 are passed through the top and bottom walls of the guide body. A close running fit is provided between the openings and a strip of banding material 76 that is passed through the openings. A threaded hole 80 passes into the guide body through back end face 81. The elongated handle 63 has a male thread 83 at one end that mates with the female thread in the guide body so that the two sections of the guide can be joined in assembly. The length of the handle can be varied to accommodate pallets of different lengths.

Figure 4:
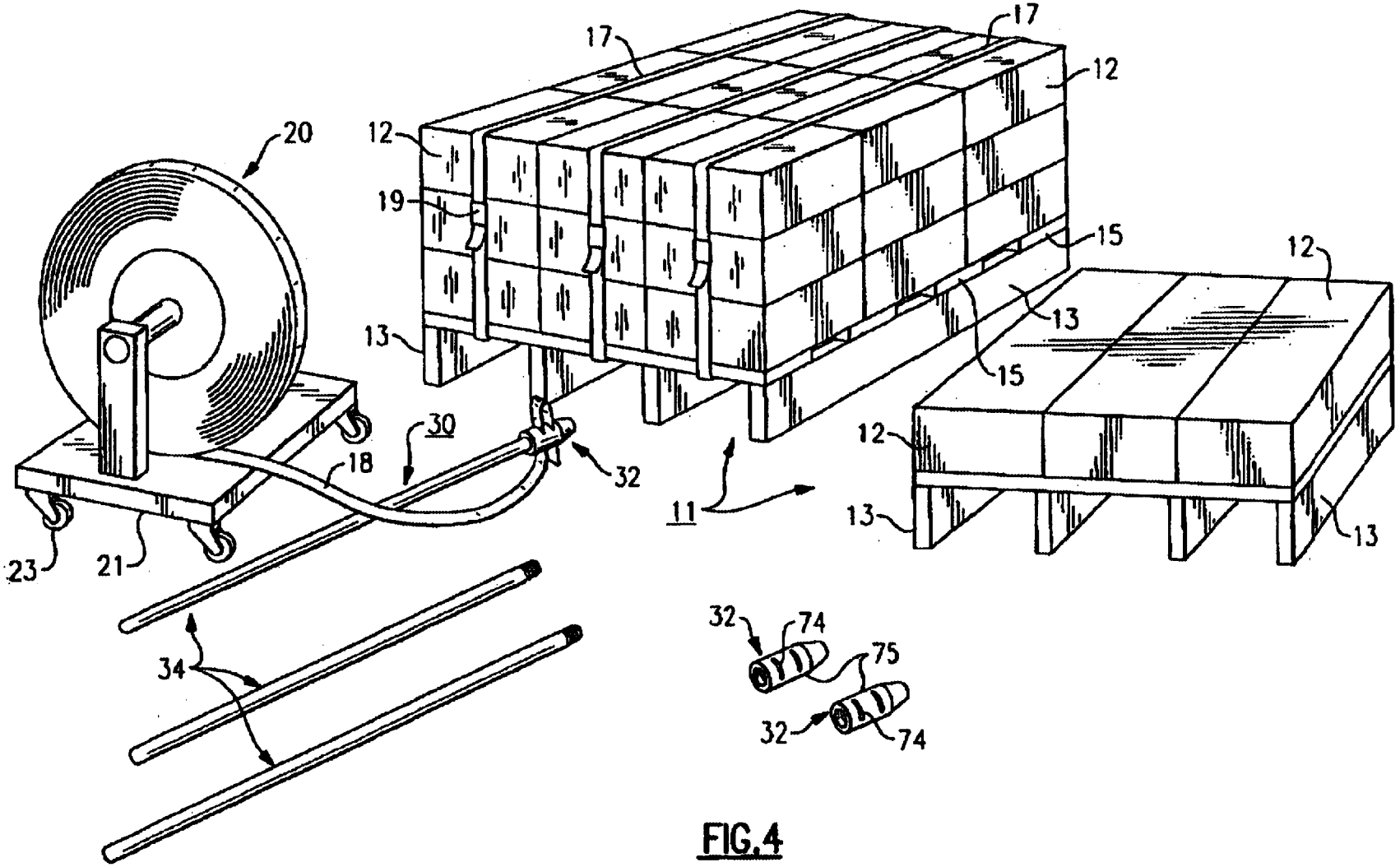
FIG. 4 is a perspective view of a system made in accordance with the present invention.

Referring to FIG. 4, a series of interchangeable handles 14, each having a different length, may be provided with the head 32. Accordingly, the length of the guide can be rapidly changed to accommodate pallets 11 of varying lengths. By the same token, a series of heads 32 can also provided, each of which contains a pair of different sized slotted holes 74, 75 for accommodating different size banding materials. A system can thus be developed that will be able to supply different size pallets 11 with different size bands.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. A guide for passing a tie-down band underneath a pallet that includes:

a guide body having a pair of spaced apart, parallel slotted holes passing through said body, each slotted hole having a cross section that allows the tie-down band to pass through said guide body whereby one end of said band can be passed through a first slotted hole in one direction, then looped around and passed back through a second slotted hole in the opposite direction to secure the band in the guide body; and an elongated handle secured to the guide body, said handle having a length that is about equal to or greater than the length of the pallet.

2. The guide of claim 1 wherein said guide body contains at a front face and a rear face.

3. The guide of claim 2 that further includes a truncated nose cone mounted upon the front face of the guide body.

4. The guide of claim 3 wherein the guide body and the nose cone are integrally molded of plastic.

5. The guide of claim 1 wherein the slotted holes provide a close running fit with the tie-down band.

6. The guide of claim 1 wherein said handle is removably connected to said guide body so that handles of varying length can be interchangeably secured to the guide body.

7. The guide of claim 3 wherein one end of said handle is threaded into the guide body through the rear face of said body.

8. The guide of claim 1 wherein said slotted holes are perpendicularly aligned with the axis of the guide body.

9. The guide of claim 8 wherein said handle is coaxially aligned with the axis of the guide body.

10. The guide of claim 1 wherein said guide body is a cylinder.

11. The guide of claim 1 wherein the guide body is rectangular.

12. The guide of claim 9 wherein said guide body has at least one flat surface that is parallel with the axis of the guide body.

13. The guide of claim 9 wherein said guide body has a front face and a rear face that is perpendicular to the axis of the guide body.

14. The guide of claim 10 that further includes a truncated nose cone mounted upon the front face of said guide body.

15. The guide of claim 11 wherein said guide body is integrally molded with a nose cone.

16. The guide of claim 9 wherein said handle contains a threaded end that can be mated with a threaded hole contained in the rear face of said guide body.

17. A system for efficiently passing various size tie-down bands beneath pallets of differing lengths that includes:

a plurality of guide bodies, each guide body of said plurality of guide bodies having a pair of spaced apart slotted holes which are in parallel alignment which pass through each said guide body so that one end of one of said various size tie-down bands can be passed through one of the slotted holes, looped around and passed back through a second of the slotted holes to hold the band in the guide body;

each said slotted hole pair in each of the guide bodies being of a different size from the slotted hole pairs in the other guide bodies of said plurality of guide bodies and;

a plurality of elongated handles of varying lengths, each said handle being interchangeably connectable with each of the guide bodies.

* * * * *